US006378916B1

(12) United States Patent
Huang

(10) Patent No.: US 6,378,916 B1
(45) Date of Patent: Apr. 30, 2002

(54) PRESS-STYLE AUXILIARY LOCK

(76) Inventor: I-Li Huang, No. 18 To Chiang St., Kaohsiung City (TW)

( * ) Notice: Subject to any disclaimer, the term of this patent is extended or adjusted under 35 U.S.C. 154(b) by 0 days.

(21) Appl. No.: 09/557,659

(22) Filed: Apr. 25, 2000

(51) Int. Cl.[7] ..... E05C 9/00

(52) U.S. Cl. ..... 292/27; 292/170; 292/DIG. 4; 292/DIG. 37; 70/107

(58) Field of Search ..... 292/170, 4, 11, 292/27, 47, 56, 127, DIG. 4, DIG. 11, DIG. 37; 70/107

(56) References Cited

U.S. PATENT DOCUMENTS 3,596,952 A * 8/1971 Hinkle ..... 292/DIG. 37

4,538,844 A * 9/1985 Watanabe ..... 292/DIG. 37

* cited by examiner

*Primary Examiner*—Flemming Saether

(57) ABSTRACT

A press-style auxiliary lock for a door, a cabinet, a drawer, etc. is not used for anti-theft, or anti-prying open, but only used for secured to its place, not self-opening, not swaying or vibrating by external environmental condition. It includes a press member to push a drive means to rise and push up an engage means, which cannot then move down, and also bringing interactive rods rotate to extend hooks out of the lock to rotate and hook to achieve inserting engagement and hooking engagement by a single press action. When it is not pressed in, an object provided with the lock is normally secured in its place, and when pressed once, it may be secured to its place by inserting engagement and hooking engagement.

1 Claim, 10 Drawing Sheets

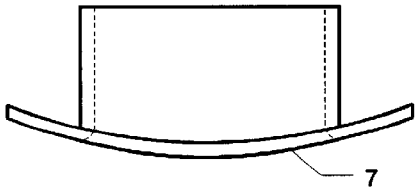
FIG. 14
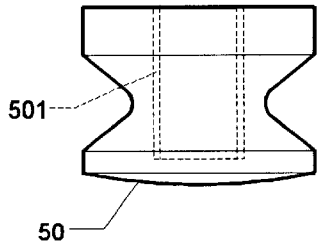
FIG. 11
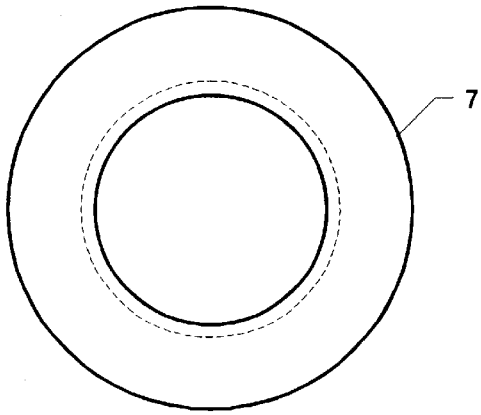
FIG. 13
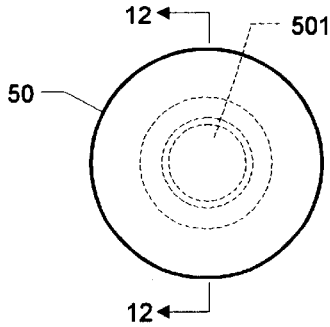
FIG. 10
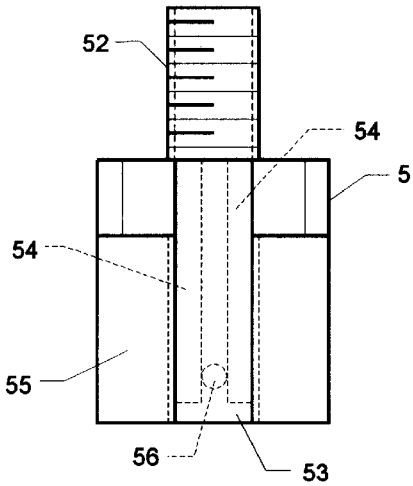
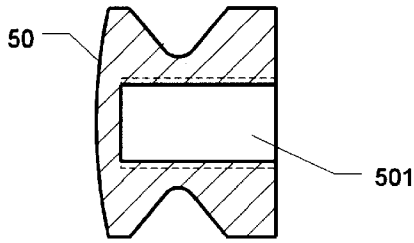
FIG. 12
FIG. 9
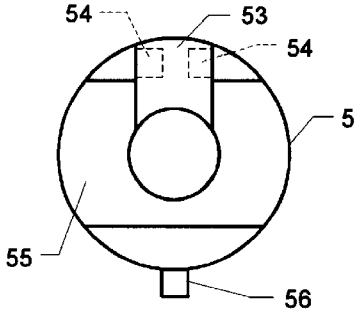
FIG. 7
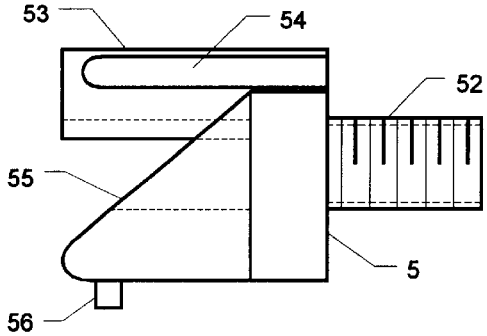
FIG. 8

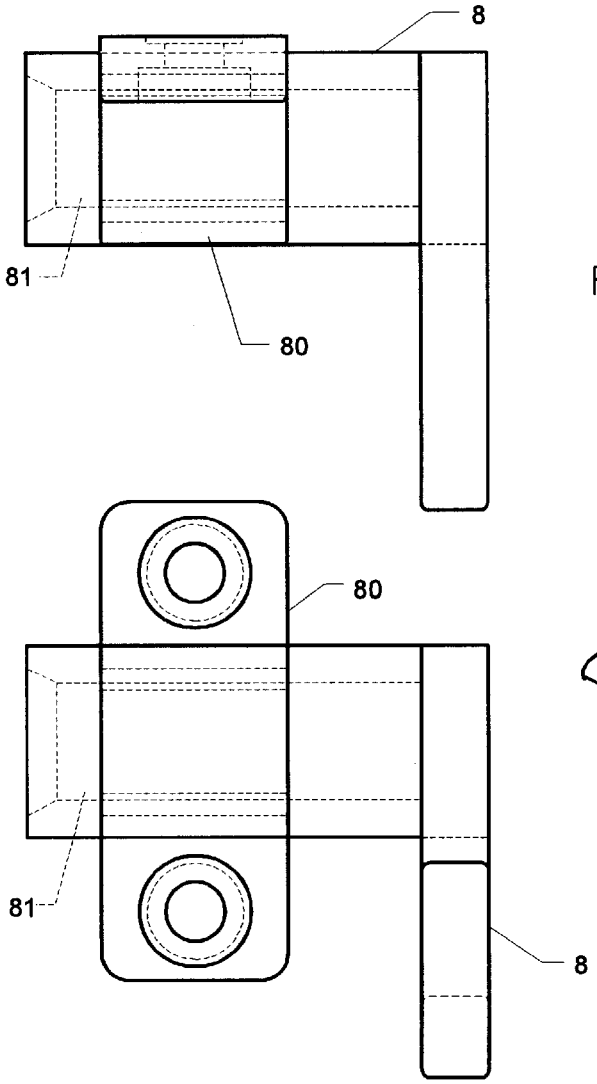
FIG. 35
FIG. 36
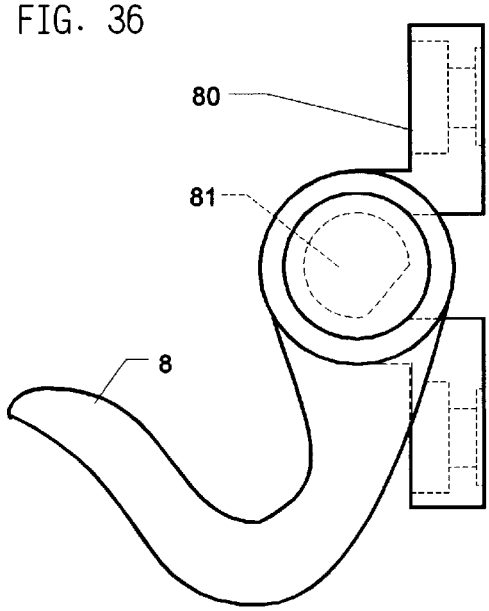
FIG. 37
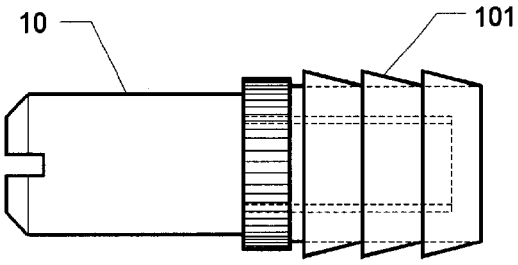
FIG. 38
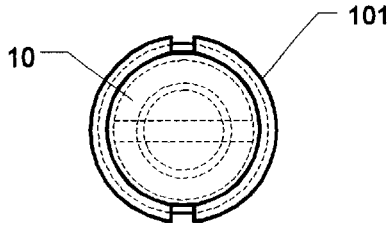
FIG. 39

PRESS-STYLE AUXILIARY LOCK

BACKGROUND OF THE INVENTION

This invention relates to a press-style auxiliary lock, particularly to one mainly for securing to its place, not self-opening, not swaying or vibrating owing to exterior movement, not for anti-theft, used for various doors, cabinets, drawers, etc.

SUMMARY OF THE INVENTION

This invention offers a press-style auxiliary lock, having the following objectives and functions.

1. It is used to automatically secure a door, a cabinet, a drawer, etc. to its place, but normally opened very conveniently.

2. It can achieve inserting and engaging function by pressing in, further producing double stabilization, (inserting engagement and hooking engagement). preventing them from self-opening.

3. It can be applied to doors, cabinets, drawers in ships, or earthquake-prone areas, keeping them surely closed, not self-opening in case of sway and earthquakes, etc.

BRIEF DESCRIPTION OF DRAWINGS

This invention will be better understood by referring to the accompanying drawings, wherein:

FIG. 7 is a side view of a press member in the present invention.

FIG. 8 is a right side view of FIG. 7.

FIG. 9 is an upper view of FIG. 7.

FIG. 10 is a front view of a grip in the present invention.

FIG. 11 is an upper view of FIG. 10.

FIG. 12 is a cross-sectional view of the line 12—12 in FIG. 10.

FIG. 13 is a front view of a decorative cap of a press hole in the present invention.

FIG. 14 is an upper view of FIG. 13.

FIG. 35 is a front view of a hook in the present invention.

FIG. 36 is an upper view of FIG. 35.

FIG. 37 is a right side view of FIG. 35.

FIG. 38 is a front view of a passive rod in the present invention.

FIG. 39 is a right side view of FIG. 38.

DETAILED DESCRIPTION OF THE PREFERRED EMBODIMENT

Figure 2:
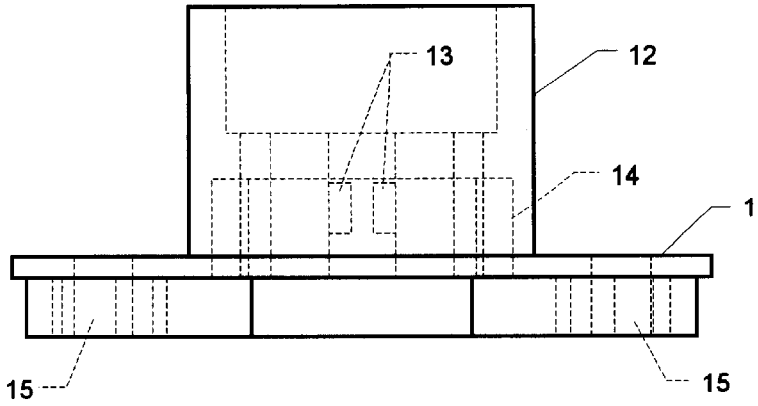
FIG. 2 is an upper view of FIG. 1.
Figure 1:
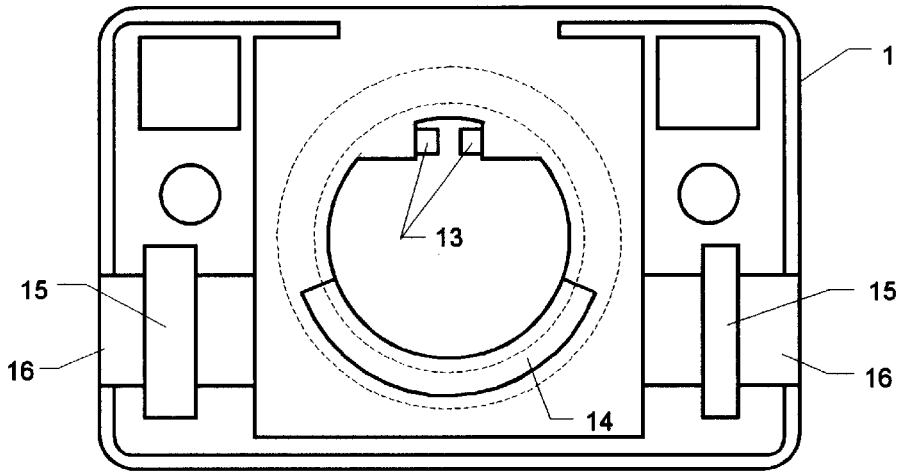
FIG. 1 is a rear view of an outer housing in the present invention.

A preferred embodiment of a press-style auxiliary lock in the present invention, as shown in FIG. 1–6, includes an outer housing 1, an inner housing 2, an engage means 3, a drive means 4, a press member 5, a grip 50, a position guide plate 51, two interactive rods 6 and 60, a decorative cover 7, a hook 8, a connect rod 9 and a hook rod 10 as main components.

Figure 43:
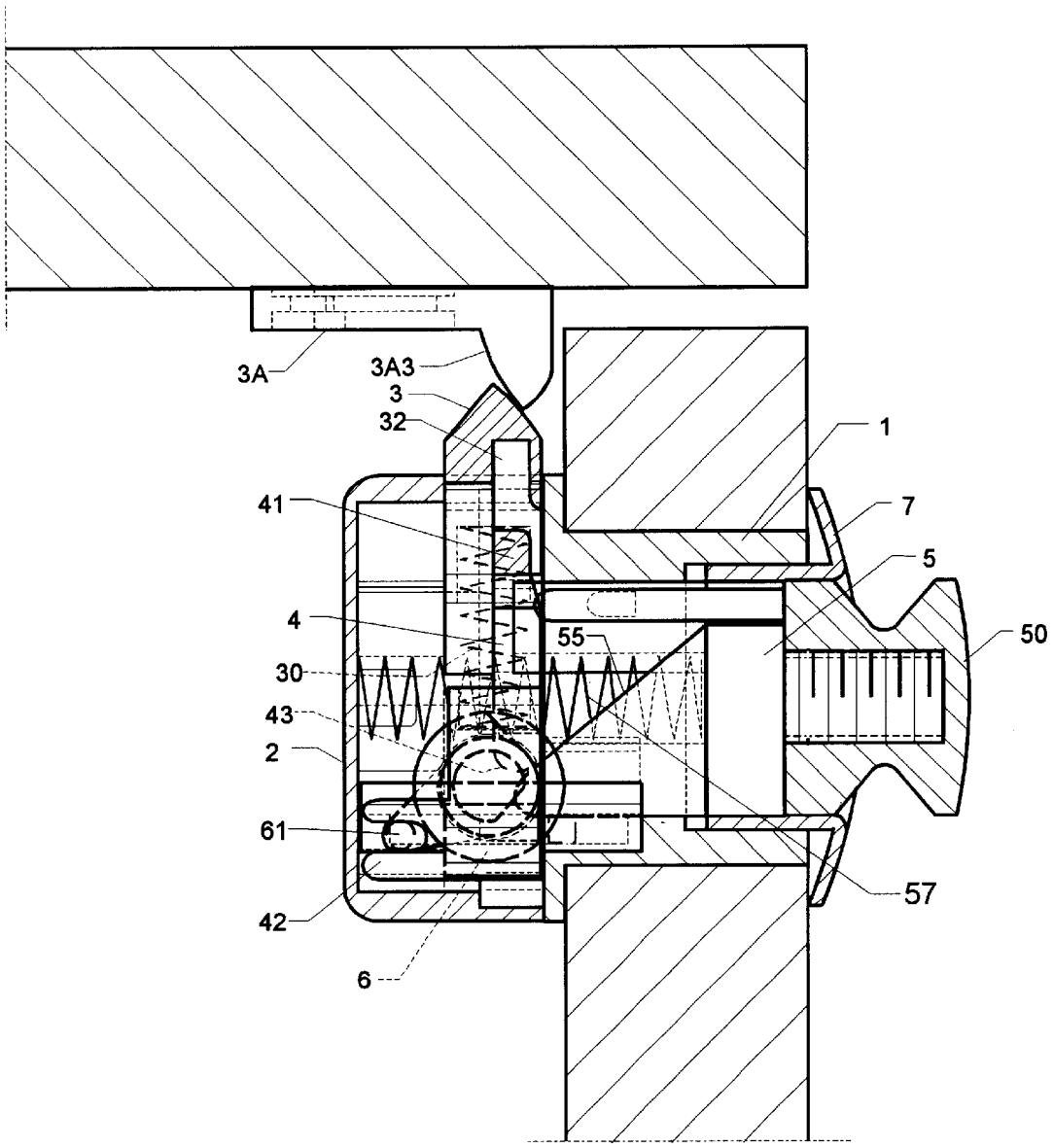
FIG. 43 is a cross-section of the press-style auxiliary lock normally keeping immovable an object in the present invention.
Figure 44:
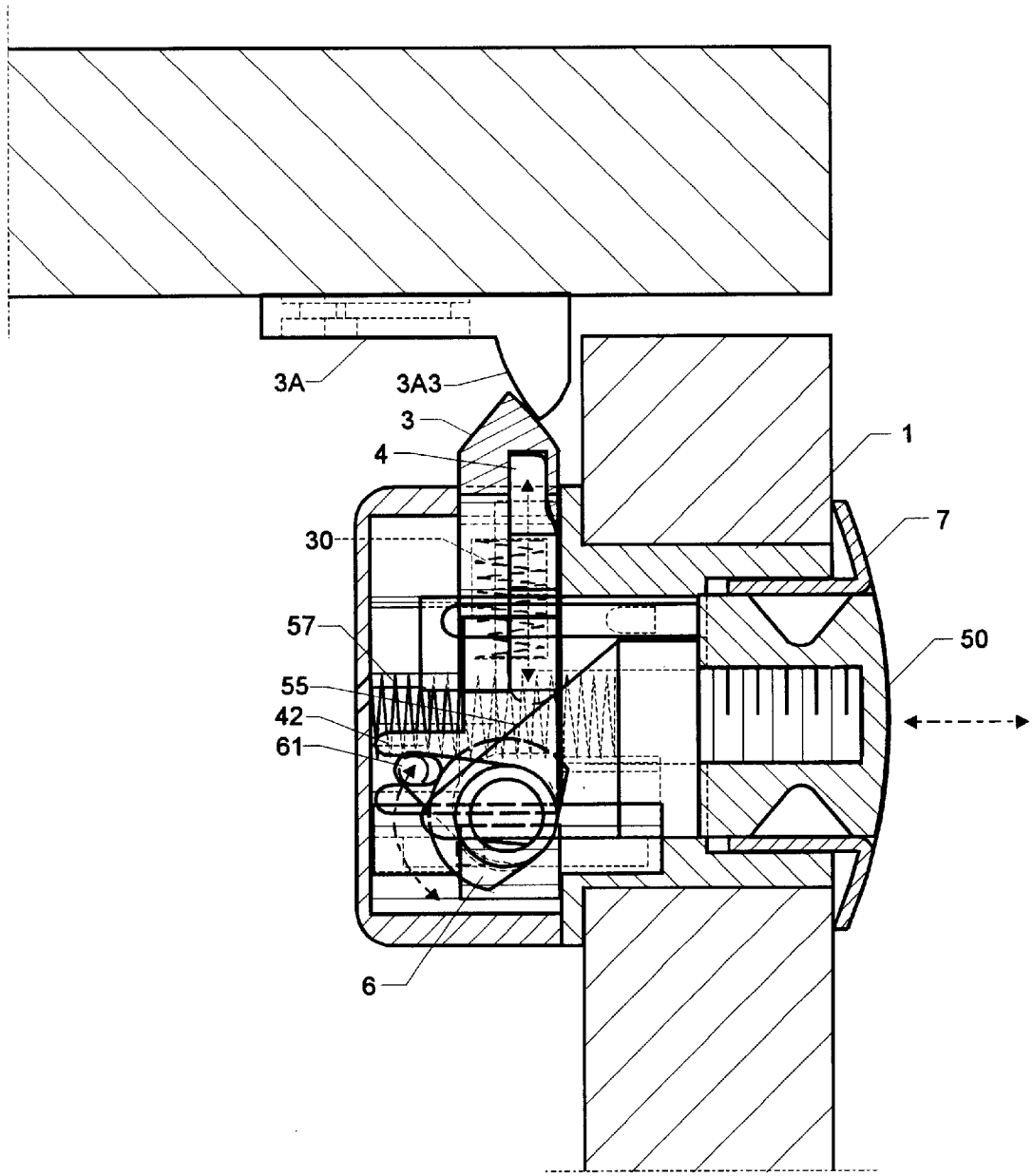
FIG. 44 is a cross-sectional view of the press-style auxiliary lock pressed to form inserting engagement and hooking engagement in the present invention.

The outer housing 1 and the inner housing 2 are combined with each other to become integral. The outer housing 1 has a cylindrical member 12 extending to the front to combine with a press member 5 attached with the grip 50 (as shown in FIGS. 43, 44). Two projecting blocks 13 are provided in the cylindrical member 12 for the press button 5 to fit in to combine the press member 5. Further, the cylindrical member 12 has a curved groove 14 formed in an inner lower wall to combine a position guide plate 51 therein. The outer housing 1 has a position room 15 respectively formed at two sides respectively for the left and the right interactive rods 6 and 60 to fit therein, and a semicircular aperture 16 formed at two side walls for a connect rod 9 located between the interactive rods 6 and 60 and the hook 8 to extend therein.

Figure 3:
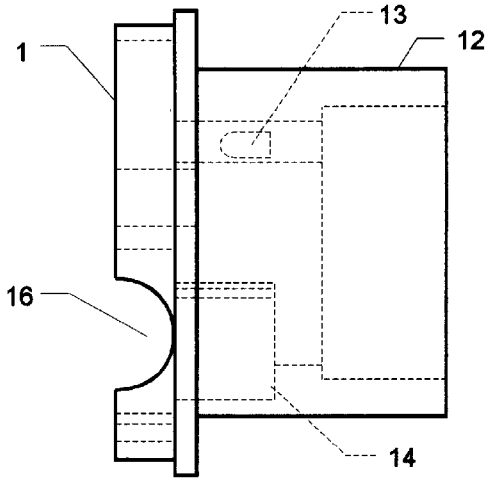
FIG. 3 is a right side view of FIG. 1.

As shown in FIG. 3, the outer housing 1 and the inner housing 2 are combined together as integral, and the outer housing 1 has a hollow cylinder 12 fixed at the front for fitting the press member 5 with the grip 50 as shown in FIGS. 43, 44. A curved groove 14 is formed in a lower wall of the cylindrical member 12 to combine a position guide plate 51. Further, the outer housing 1 has a position room 15 respectively at two sides for the left and the right interactive means 6 and 60 to fit therein, and a semicircular aperture 16 respectively formed in two side walls for the connect rod 9 provided between the interactive rods 6, 60 and the hook 8 to extend therein.

Figure 5:
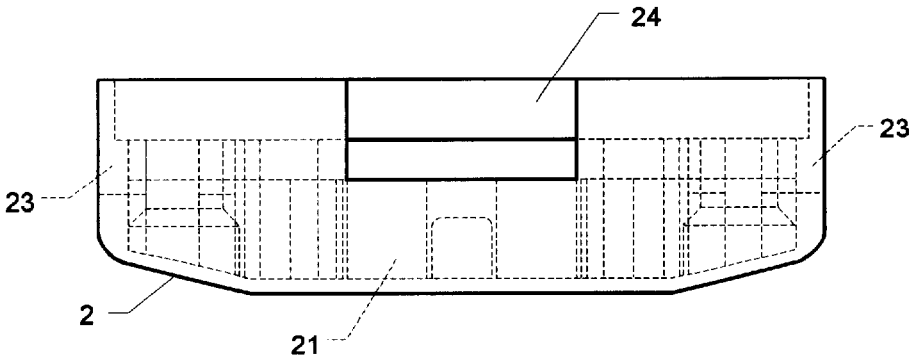
FIG. 5 is an upper view of FIG. 4.
Figure 4:
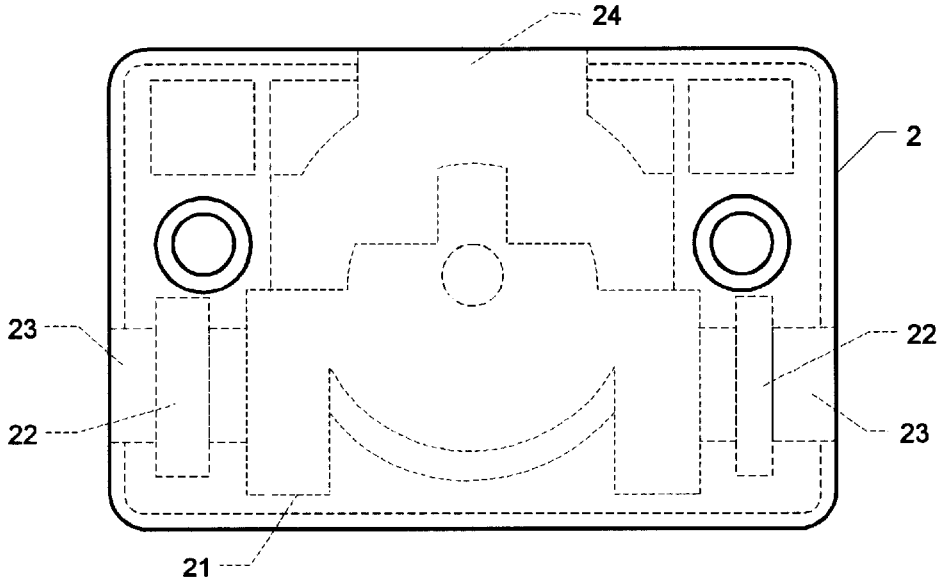
FIG. 4 is a rear view of an inner housing in the present invention.
Figure 6:
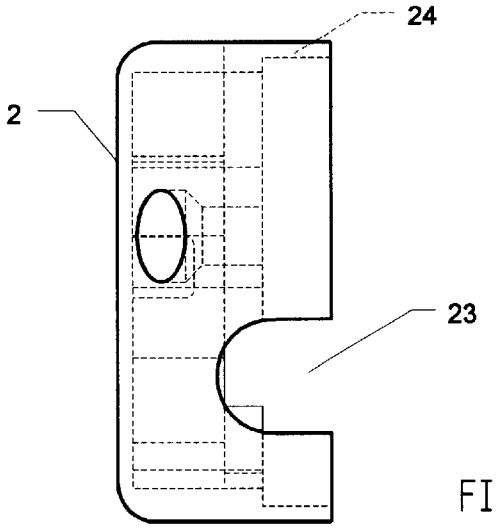
FIG. 6 is a right side view of FIG. 4.
Figure 16:
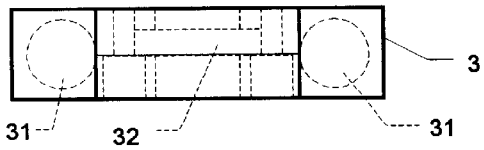
FIG. 16 is an upper view of FIG. 15.
Figure 15:
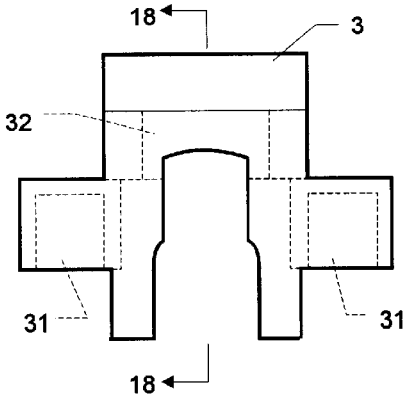
FIG. 15 is a front view of an engage means in the present invention.
Figure 17:
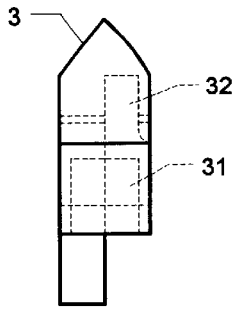
FIG. 17 is a right side view of FIG. 15.
Figure 18:
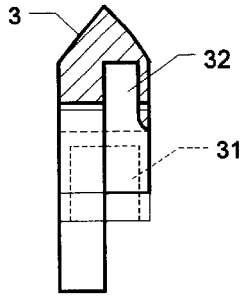
FIG. 18 is a cross-sectional view of the line 18—18 in FIG. 15.
Figure 20:
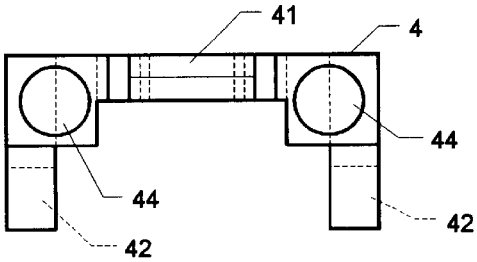
FIG. 20 is an upper view of FIG. 19.
Figure 19:
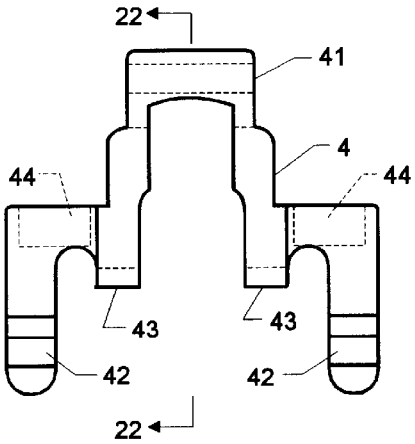
FIG. 19 is a front view of a drive means in the present invention.
Figure 21:
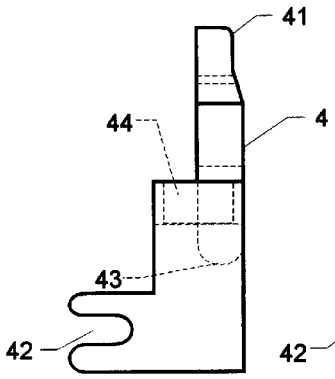
FIG. 21 is a right side view of FIG. 19.
Figure 22:
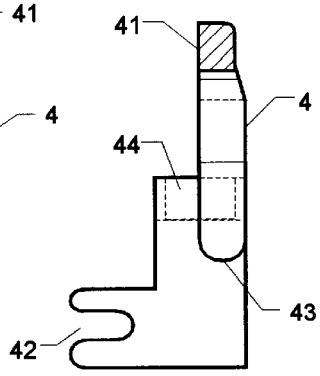
FIG. 22 is a cross-sectional view of the line 22—22 in FIG. 19.
Figure 24:
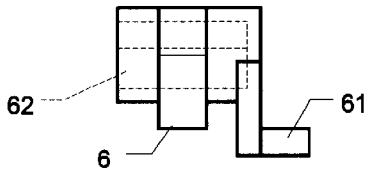
FIG. 24 is an upper view of FIG. 23.
Figure 27:
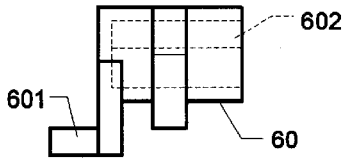
FIG. 27 is an upper view of FIG. 26.
Figure 25:
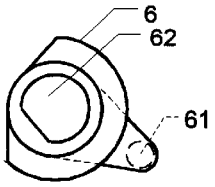
FIG. 25 is a left side view of FIG. 23.
Figure 23:
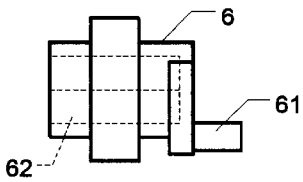
FIG. 23 is a front view of a left interactive means in the present invention.
Figure 26:
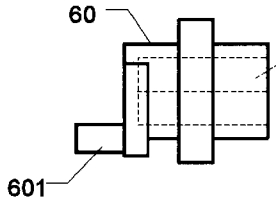
FIG. 26 is a front view of a right interactive rod in the present invention.
Figure 28:
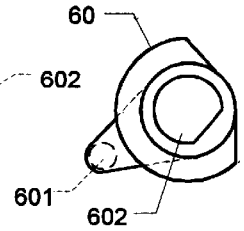
FIG. 28 is a right side view of FIG. 26.

The inner housing 2, as shown in FIGS. 4–6, has a drive means room 21 to contain the drive means 4, and a position room 22 formed each at two sides of the room 21, and an aperture 23 formed respectively in two side walls for the connect rod 9 provided between interactive rods 6, 60 and the hook to extend therein, and an opening 24 formed in a front upper wall for the engage means 3 to move in and out.

Next, as shown in FIGS. 7–12, a threaded rod 52 is provided to extend forward from the press member 5 to screw in a threaded hole 501 of the grip 50 as one unit of a press structure as shown in FIGS. 43, 44. The press member 5 has a guide block 53 on an upper side, and a guide hole 54 at two sides of the guide block 53 for the projecting blocks 13 of the hollow cylinder 12 to fit therein. The press member 5 further has a slope 55 formed in a rear portion for the drive means 4 to slide along upward, and a guide block 56 formed under the lower surface to fit and move in a guide rail 511 of the position guide plate 51 .to let the press member 5 pressed in and secured or released to move out. Further, a spring 57 is provided between the press member 5 and the inner wall of the inner housing 2 to let the press member 5 easily pushed outward elastically.

The engage means 3, as shown in FIGS. 15–18, has a hole 31 opening downward each at two sides for a coil spring 30 located between the engage means 3 and the drive means 4 to fit and located therein, and a drive means room 32 formed in a front half portion for the drive means 4 to extend therein when the drive means 4 rises up, so the drive means 3 not only rotates for hooking when rises up, but also pushes up the engage means 3, which then cannot descend and protrudes firmly up to insert.

The drive means 4 shown in FIGS. 19–22 has an upper block 41 to rise and extend in the room 32 of the engage mans 3 to push up the engage means 3 from under, and an aperture 42 formed each in two lower sides for receiving posts 61, 601 of the interactive rods 6, 60 therein stabilized, a curved contact surface 43 formed each at two sides of a center hole to contact with the slope 55 of the press member 5 to engage the drive means 4 to move up together in case of the drive means 4 pressed, and a hole 44 formed each at two upper sides for the coil springs 30 to fit in.

FIGS. 23, 24, 25, 26, 27 and 28 show the left and the right interactive rods 6 and 60, which have the same but asymmetrical structure and different size and thickness according to the space planned, while they act in the same way. The left and the right interactive rods 6 and 60 respectively have a post 61, 601 on an inner side for the aperture 42 of the drive means 4 to fit with, and an insert hole 62, 602 opening outward for one end of the connect rod 9 between the interactive rods 6, 60 and the hook 8 to insert therein.

Figure 30:
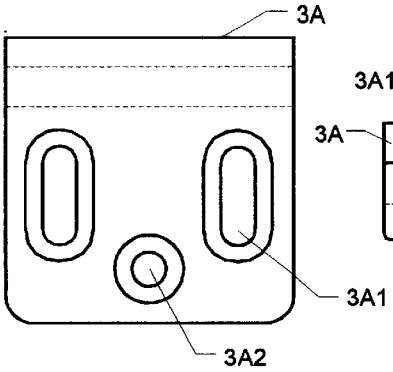
FIG. 30 is an upper view of FIG. 29.
Figure 29:
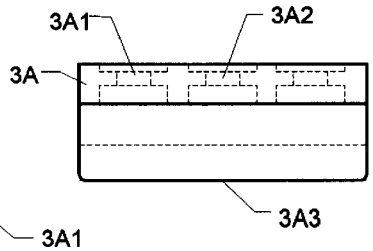
FIG. 29 is a front view of a restrain plate in the present invention.
Figure 31:
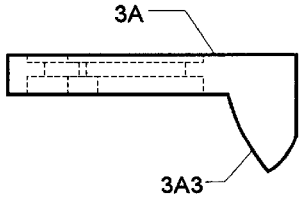
FIG. 31 is a right side view of FIG. 29.

A restrain plate 3A shown in FIGS. 29, 30, and 31 is for the engage means to engage with, having two elongate slots 3A1 and at leans one through hole 3A2 to secure the restrain plate 3A on a preset location of an object to install this lock, and a lower edge 3A3 projecting down for a preset length.

Figure 33:
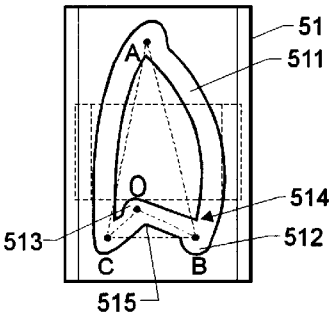
FIG. 33 is an upper view of FIG. 32.
Figure 32:
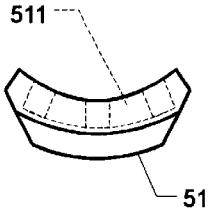
FIG. 32 is a front view of a position guide plate in the present invention.
Figure 34:
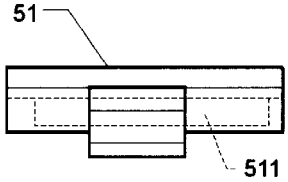
FIG. 34 is a right side view of FIG. 32.

The position guide plate 51 shown in FIGS. 32, 33, and 34 is for controlling the press member 5 to be pressed in and secured in its place and pressed again to release to move up, having a guide rail 511 of a nearly triangular sealed route forming a three triangle with three points A, B, C and another triangle with other three points B, O, C. And the side AB is longer than OB (AB>OB) and the side AC is longer than the side OC (AC>OC), and the side BC is common. The points B and O respectively have a recess 512, 513 and a guide angle 514, 515 opposite to the recess 512, 513. Then when the press member 5 is pressed in, the guide block 56 moves along the side AB into the recess 512. But when the press member 5 is pressed again to release, the guide block 56 is guided by the guide angle 514 to slide into the recess 153 to let the press member 5 pressed in to secure at its place. If the press member 5 is further pressed, the guide block 56 moves outward along the guide angle 515 to the point C and then returns to the point A via the side CA. In this way the press member 5 is controlled in pressing and releasing to stabilize to its position.

Figure 47:
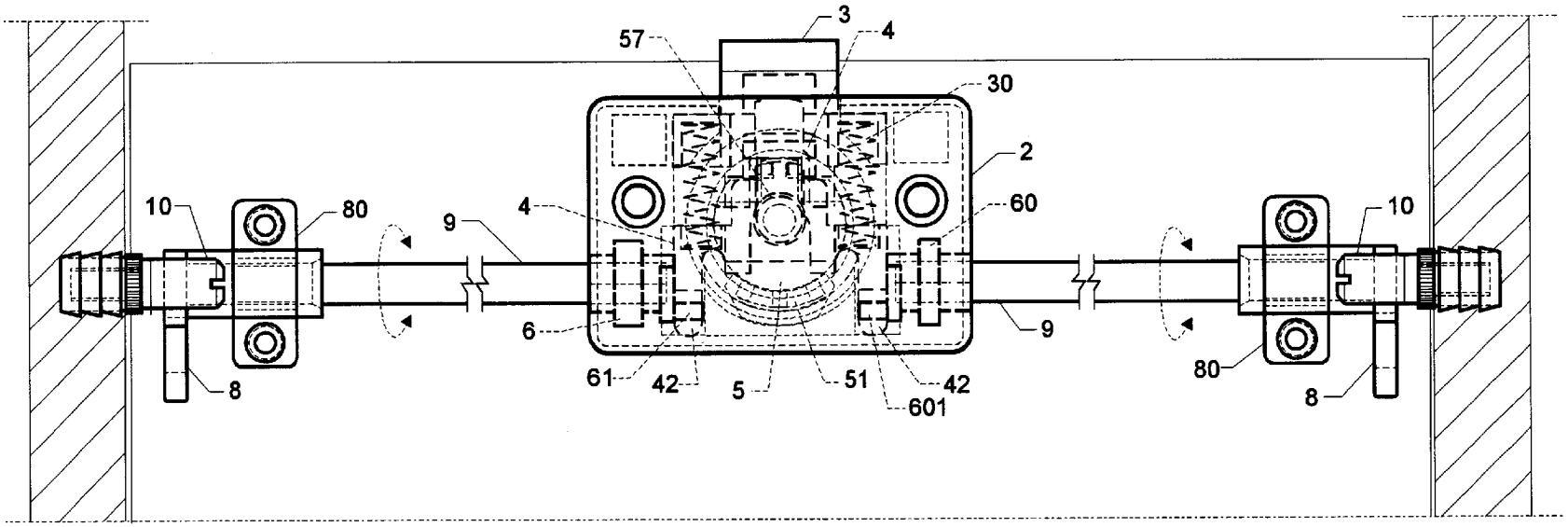
FIG. 47 is a cross-sectional view of the press-style auxiliary lock under the insert engagement and the hook engagement in the present invention.

The hook 8 shown in FIGS. 35, 36, and 37 is clamped by a constrictor 80, having one end formed with a insert hole 81 for one end of the connect rod 9 located between the interactive rods 6, 60 and the hook 8 to insert therein, as shown in FIG. 47.

Figure 40:
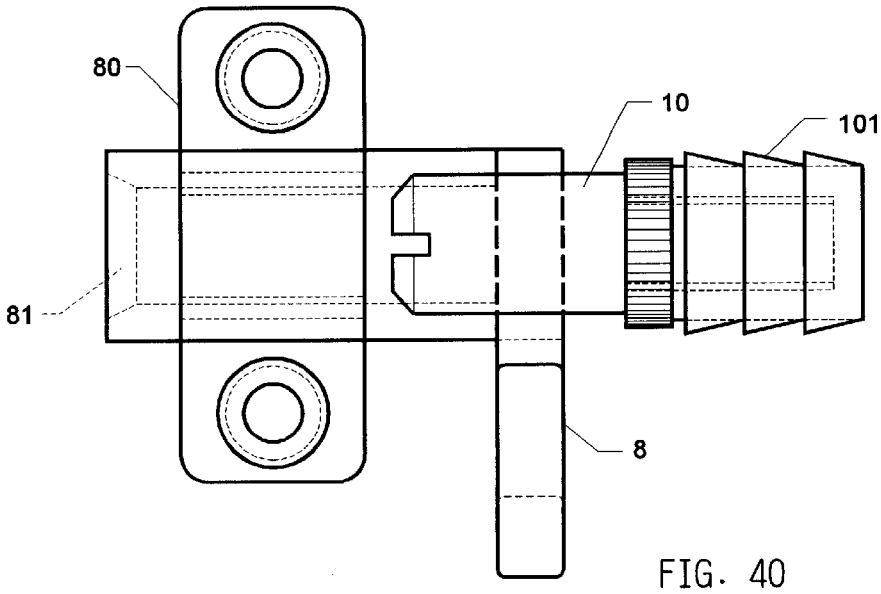
FIG. 40 is a relative view of the hook and the passive rod in the present invention.
Figure 41:
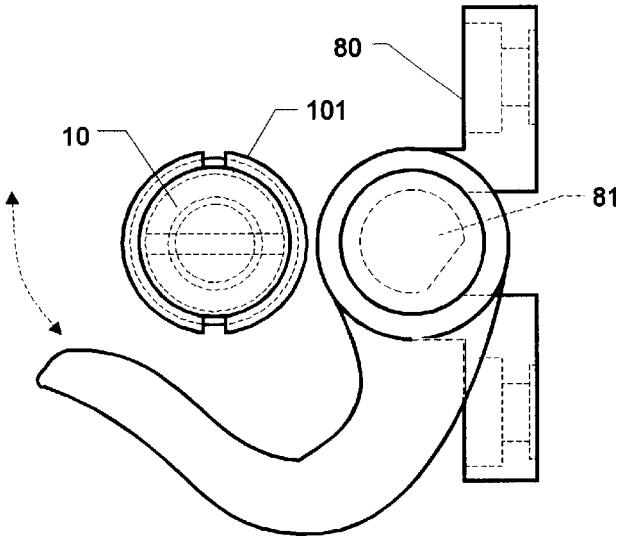
FIG. 41 is a right side view of FIG. 40.
Figure 42:
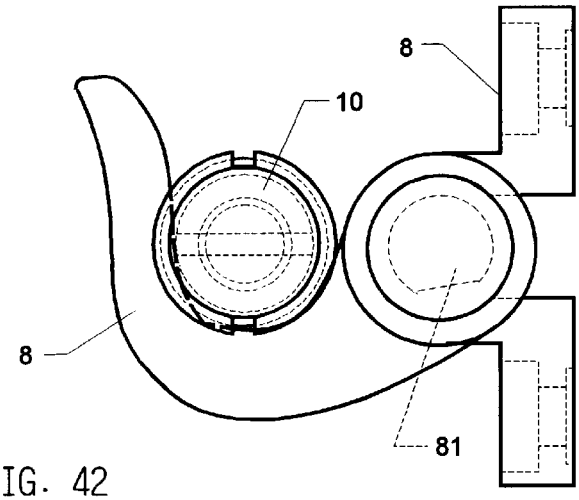
FIG. 42 is a side view of the hook under hooking movement in the present invention.

FIGS. 38 and 39 show a passive rod 10 to be hooked by the hook 8, having a ratchet-shape post 101 formed in a rear portion and a front portion for the hook 8 to hook as shown in FIGS. 40, 41 and 42.

Next, in using, when the grip 50 is not pressed in, the guide block 56 of the press member 5 is located at the point A of the guide plate 51, with the drive means 4 not yet rising up, and with the curved contact surface 43 located near under the slope 55 of the press member 5. And the engage means 3 may be moved to extend or shrink by means of the coil springs 30 by opening or closing a door or a window.

Figure 46:
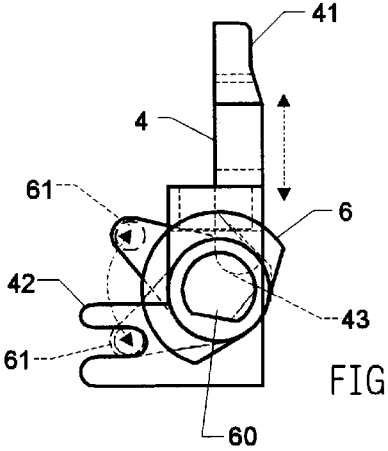
FIG. 46 is a relative view of the drive means and the interactive means under mutual movement in the present invention.
Figure 45:
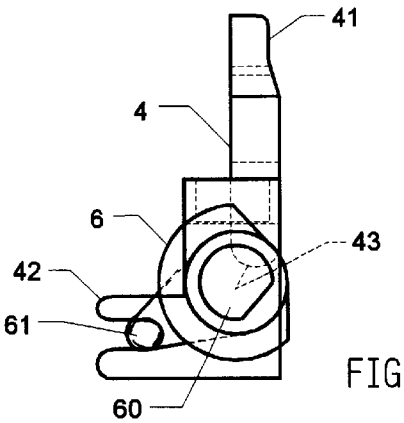
FIG. 45 is a relative view of the drive means and the interactive means in the present invention.

As shown in FIG. 44, when the grip 50 is pressed in, the press member 5 moves in at the same time, letting the drive means 4 rise along the slope 55 of the press member 5, pushing up the engage means 3, forcing the aperture 42 rotate the two interactive rods 6, 60 for a certain angle at the same time as shown in FIG. 46, and letting the connect rod 9 move the two hooks 8 at two ends hook the passive rod 10, as shown in FIG. 47.

The press-style auxiliary lock in the invention has the following advantages.

1. When the grip is not yet pressed in, the engage means may move along with a door, a cabinet, or a drawer to open or close, freely receiving expansion and shrinkage.

2. When the grip is pressed in, the drive means rises up to let two hooks hook the passive rod and rise to push up the engage means, which then cannot descend, achieving inserting engagement and hooking engagement synchronously.

3. Its structure is simple, and a single press action can perform double fixing effect (engaging and hooking).

While the preferred embodiment of the invention has been described above, it will be recognized and understood that various modifications may be mad therein and the appended claims are intended to cover all such modifications that may fall within the spirit and scope of the invention.

What is claimed is:

1. A press-style auxiliary lock comprising an outer housing and an inner housing, an engage means fixed in said outer housing and said inner housing to protrude up, a drive means possible to rise up and to let a hook rotate, a press member and a grip connected to said press member for controlling said drive means to rise up, a position guide plate with a guide rail to guide said press member in moving and securing to its place, two interactive rods moving and rotating with said drive means, a decorative cap closing on a press hole of an object to fix said auxiliary lock, a connect rod connected between said interactive rods and said hooks, and a passive rod fixed on said object to be hooked:

said outer housing and said inner housing combined together integral, a hollow cylinder fixed on a front side of said outer housing to combine with said press member and said grip, said hollow cylinder having two opposite projecting blocks inside for said press member to insert in a gap between said two projecting blocks, said hollow cylinder having a curved groove formed in a lower inner wall for said position guide plate to combine with, said outer housing further having a position room respectively provided at two sides to combine a left and a right interactive rod, said outer housing having a semicircular aperture formed respectively in two side walls for connect rods between said interactive rods and hooks to insert therein:

said outer housing and said inner housing combined together integral, said inner housing having a drive means room for containing said drive means, a position room formed at two sides of said drive means room for containing said interactive rods, a semicircular aperture formed in two side walls for said connect rods between said interactive rods and said hooks to extend therein, said inner housing having an aperture formed in a front upper surface for said engage means to move in and out:

said press member having said grip fixed on its front side, and a guide block formed on an upper side, a guide groove respectively formed at two sides for said projecting blocks of said hollow cylinder to engage, said press member having a slope in a rear portion for said drive means to rise up along, said press member having a guide block formed under a lower edge to fit and move in said guide rail of said position guide plate, and a coil spring placed between said press member and an inner wall of said inner housing:

said engage means having a hole respectively opening downward in two sides for said coil springs located between said engage means and said drive means to fit therein, and a hollow room in a front half portion for said drive means to fit therein when said drive means is raised:

said drive means having a top block to rise and extend in said engage means to push up said engage means and an aperture respectively formed in two lower sides for projecting posts of said interactive rods to fit and stabilized, said drive means having two curved contact surfaces at two sides of a center hole to contact with and move up and down said slope of said press member, a hole opening upward formed respectively at two sides for said coil springs between said engage means and said drive means to fit therein:

said interactive rods having a projecting post formed inside to fit in said aperture of said drive means, an inner insert hole formed in an outer side for one end of said connect rod between said interactive rods and said hook to fit in:

a restrain plate provided for said engage means to engage with, having an engage edge protruding out with a preset length, said engage edge having a sloped surface or a curved surface each at two sides, said position plate controlling said press member in pressing in to stabilize and pressing again to release to move up, having said guide rail of sealed curved routes, said guide rail having four points of A, B, C and O, said three points A, B C forming a triangle, said three points B, O, C forming another triangle, a side AB being longer than a side OB (AB>OB), a side AC being longer than OC (AC>OC), a side BC being common for said two triangles, said points B and O having respectively a recess and a guide angle located opposite to said two recesses:

said hooks respectively clamped by a position constrictor in its place, having one end formed with an insert hole for one end of said connect rod between said interactive rods and said hook to insert:

said passive rod hooked by said hook having a lower ratchet-shaped portion and a front portion formed to have a certain length and a certain outer diameter:

said lower guide block of said press member located at said A point of said position plate and said drive means being not raised up with its curved contact surface located near under said slope of said press member to let said engage means freely extend or shrink by means of said coil springs according to opening or closing of a door, a cabinet or a drawer so that said auxiliary lock may be easily opened or closed when said grip being not yet pressed in, said drive means being raised up along said slope of said press member and pushing up said engage means, said aperture carrying said interactive rods at two sides to rotate for a preset angle to let said connect rod carrying said hooks at two ends to hook said passive rods at the same time when said grip together with said press member is pressed in.

* * * * *